US009147942B2

(12) United States Patent
Pintos et al.

(10) Patent No.: US 9,147,942 B2
(45) Date of Patent: Sep. 29, 2015

(54) MULTIBEAM ANTENNA SYSTEM

(75) Inventors: Jean-François Pintos, Saint Blaise du Buis (FR); Philippe Minard, Saint Medard sur Ille (FR); Ali Louzir, Rennes (FR); Dominique Lo Hine Tong, Rennes (FR)

(73) Assignee: THOMSON LICENSING, Issy les Moulineaux (FR)

( * ) Notice: Subject to any disclaimer, the term of this patent is extended or adjusted under 35 U.S.C. 154(b) by 144 days.

(21) Appl. No.: 13/458,566

(22) Filed: Apr. 27, 2012

(65) Prior Publication Data

US 2012/0287005 A1 Nov. 15, 2012

(30) Foreign Application Priority Data

May 13, 2011 (FR) ..... 11 54154

(51) Int. Cl.
*H01Q 21/06* (2006.01)
*H01Q 19/06* (2006.01)
*H01Q 3/24* (2006.01)

(52) U.S. Cl.
CPC ..... *H01Q 21/06* (2013.01); *H01Q 3/242* (2013.01); *H01Q 19/06* (2013.01)

(58) Field of Classification Search
CPC ... H01Q 19/06; H01Q 19/062; H01Q 19/065; H01Q 19/067; H01Q 21/06; H01Q 3/24; H01Q 3/242; H01Q 3/245; H01Q 3/247
USPC ..... 343/754, 753
See application file for complete search history.

(56) References Cited

U.S. PATENT DOCUMENTS

| | | | | |
|---|---|---|---|---|
| 3,754,270 | A * | 8/1973 | Thies, Jr. | 343/754 |
| 3,852,761 | A * | 12/1974 | Bogner | 343/754 |
| 6,081,239 | A * | 6/2000 | Sabet et al. | 343/753 |
| 6,127,987 | A * | 10/2000 | Maruyama et al. | 343/835 |
| 6,313,802 | B1 * | 11/2001 | Petersson | 343/753 |
| 6,424,319 | B2 | 7/2002 | Ebling et al. | |
| 6,720,931 | B1 | 4/2004 | Michisaka et al. | |
| 7,400,304 | B2 | 7/2008 | Lewis et al. | |
| 7,800,549 | B2 | 9/2010 | Rebeiz et al. | |
| 2005/0068251 | A1 * | 3/2005 | Ebling et al. | 343/911 L |
| 2007/0001918 | A1 | 1/2007 | Ebling et al. | |
| 2009/0201204 | A1 | 8/2009 | Black, Jr. et al. | |

(Continued)

FOREIGN PATENT DOCUMENTS

| | | |
|---|---|---|
| DE | 4430832 | 11/1995 |
| WO | WO2004040696 | 5/2004 |

(Continued)

OTHER PUBLICATIONS

French Search Report dated Dec. 8, 2011.

(Continued)

*Primary Examiner* — Robert Karacsony
*Assistant Examiner* — Daniel J Munoz
(74) *Attorney, Agent, or Firm* — Tutunjian & Bitetto, P.C.

(57) ABSTRACT

A multibeam antenna system having a substrate forming a ground plane and a lens positioned on the substrate. At least one radiating element is positioned around the lens and configured to transmit and/or receive electromagnetic wave. A switching means enables one of the at least one radiating element to be selected. The lens is constituted by a cylindrical ring whose axis is perpendicular to the substrate.

6 Claims, 4 Drawing Sheets

(56) References Cited

U.S. PATENT DOCUMENTS

| | | | | |
|---|---|---|---|---|
| 2010/0207833 | A1 | 8/2010 | Toso et al. | |
| 2012/0139804 | A1 * | 6/2012 | Elliot et al. | 343/754 |

FOREIGN PATENT DOCUMENTS

| | | |
|---|---|---|
| WO | WO2010016799 | 2/2010 |
| WO | WO2010070257 | 6/2010 |

OTHER PUBLICATIONS

Lit et al. "Multibeam Antenna with Decision-Feedback Equalization for Home Wireless Communications", IEEE, Aug. 1999, pp. 23-26.

David Bidou, "Electronique des Hautes Fréquences, Optoélectronique", Contribution A L'etude D'antennes Fort Gain. Applications Dans Le Domaine Millimetrique, Docteur De L'universite De Limoges, May 2013, 262 Pages.

www.eeetimes.com_ancient_www.commdesign, Feb. 2015, pp. 1-4.

* cited by examiner

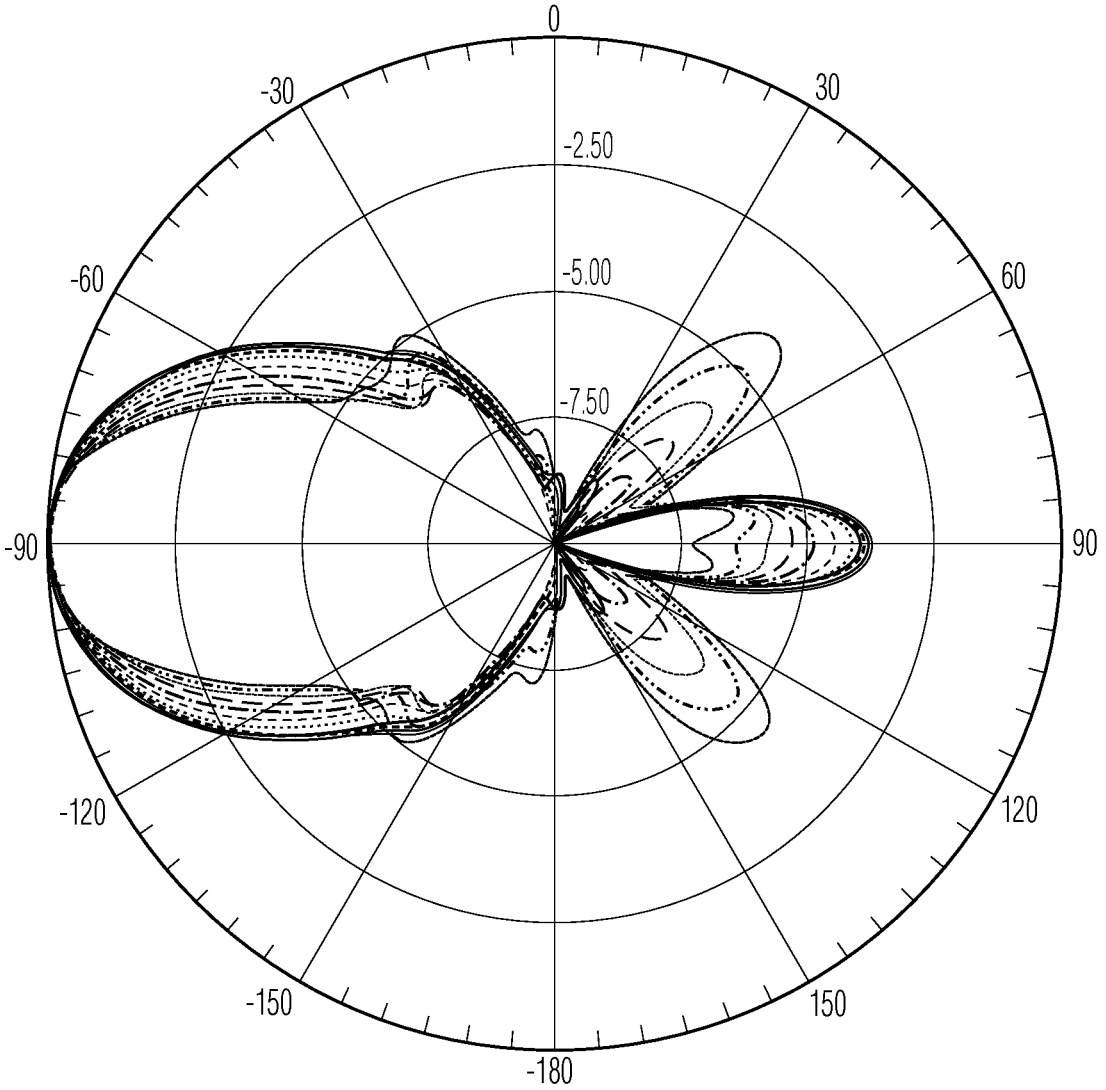

CURVE INFO

| | | |
|---|---|---|
| dB10normalize(DirTotal) Freq='5GHz' Theta='90deg' | dB10normalize(DirTotal) Freq='5.4GHz' Theta='90deg' | dB10normalize(DirTotal) Freq='5.8GHz' Theta='90deg' |
| dB10normalize(DirTotal) Freq='5.1GHz' Theta='90deg' | dB10normalize(DirTotal) Freq='5.5GHz' Theta='90deg' | dB10normalize(DirTotal) Freq='5.9GHz' Theta='90deg' |
| dB10normalize(DirTotal) Freq='5.2GHz' Theta='90deg' | dB10normalize(DirTotal) Freq='5.6GHz' Theta='90deg' | dB10normalize(DirTotal) Freq='6GHz' Theta='90deg' |
| dB10normalize(DirTotal) Freq='5.3GHz' Theta='90deg' | dB10normalize(DirTotal) Freq='5.7GHz' Theta='90deg' | |

FIG. 3

MULTIBEAM ANTENNA SYSTEM

This application claims the benefit, under 35 U.S.C. §119 of FR Patent Application 1154154, filed 13 May 2011.

FIELD OF THE INVENTION

The present invention relates to a multibeam antenna system, particularly a multibeam antenna system usable in the context of wireless communications, more particularly in the domestic networks in which the propagation conditions of electromagnetic waves are very penalising.

TECHNICAL BACKGROUND

For emerging applications such as wireless domestic networks, smart networks or similar networks, the use of directive antennas, namely antennas with the faculty of focussing the radiated power in a particular direction of space, proves to be particularly attractive. Indeed, the use of directive antennas can reduce the power of transmitters and significantly limit interferences, the reduction in power of the transmitters is translated by a reduction of costs of equipment and/or increase in the lifetime of batteries and hence the autonomy of mobile equipment or wireless sensors.

However, the laws of physics require a minimum size for antennas, this size being all the greater as the antenna is directive or its operating frequency low. Hence, until now, the use of directive antennas has remained limited to antennas operating at very high frequencies, often at fixed frequencies, and not having size constraints such as radar applications or satellite applications.

However, to increase the capacity and bitrates of wireless systems, the emerging applications such as MIMO systems (for Multiple Input Multiple Output) use multiple antenna techniques. Hence, the grouping of directive antennas into networks is sometimes necessary to ensure point to point coverage in the entire space or on 360°. Moreover, to these more or less agile semi-directive antenna devices, a digital processing unit must be added to control and shape the beams in the directions required by the system. Indeed, the basic principle of a multibeam antenna system lies in the choice of one beam among a row of diverse fixed beams pointing in prioritised and predefined directions. The switching from one beam to another is decided according to, for example, the highest signal-to-noise ratio at reception.

Hence, in terms of integrated function within a multibeam antenna system, this must comprise a beam shaper that generates multiple beams, a listening circuit that is used for determining the beam to use to enable the optimal communication and a switch that is used to select the optimal beam for the reception. Therefore, the solutions currently on the market are complex solutions and, consequently, costly and/or bulky.

SUMMARY OF THE INVENTION

The present invention thus proposes a multibeam antenna system that enables a response to the above problems by proposing a multibeam antenna system based on the joint use of a plastic lens and multiple sources.

Moreover, the present invention thus proposes a new compact multibeam antenna solution enabling pattern in different directions of space to be chosen with an extremely simple and non-expensive implementation technology.

The present invention relates to a multibeam antenna system comprising:

- a substrate forming a ground plane,
- a lens positioned on the substrate,
- at least one radiating element to transmit and/or receive electromagnetic waves positioned around the lens, and
- a switching means enabling the or at least one of the radiating elements to be selected, characterized in that the lens is constituted by a cylindrical ring whose axis is perpendicular to the substrate.

According to an embodiment, the cylindrical ring has in cross-section a circular or parallelepipedic shape. The circular ring has a thickness close to $\lambda g/4$, where $\lambda g$ is the guided wavelength. This allows an optimisation of the thickness of the lens.

Moreover, the material of the lens is chosen from among plastic materials such as polymethylmethacrylate (known under the name PLEXIGLAS® acrylonitrile-butadiene styrene (known under the name ABS). Other materials such as ceramics or magneto-dielectric materials can also be used to produce the lens. The radiating elements, themselves, are chosen from among the monopoles, patches, slots. Moreover, each monopole is associated with a reflector positioned on the external surface of the lens so as to bring the radiation of the source in the direction of the lens.

According to another characteristic of the present invention, the different radiating elements are arranged in a circle surrounding the lens. The distribution of the radiating elements in a circle increases the uniformity, namely the symmetry, of the radiation patterns between each other

BRIEF DESCRIPTION OF THE DRAWINGS

Other characteristics and advantages of the present invention will emerge upon reading the following description of an embodiment, this description being made with reference to the drawings attached in the appendix, in which:

FIG. 3 shows the radiation pattern of the system of FIG. 1 as a function of frequency.

DESCRIPTION OF AN EMBODIMENT

Figure 1:
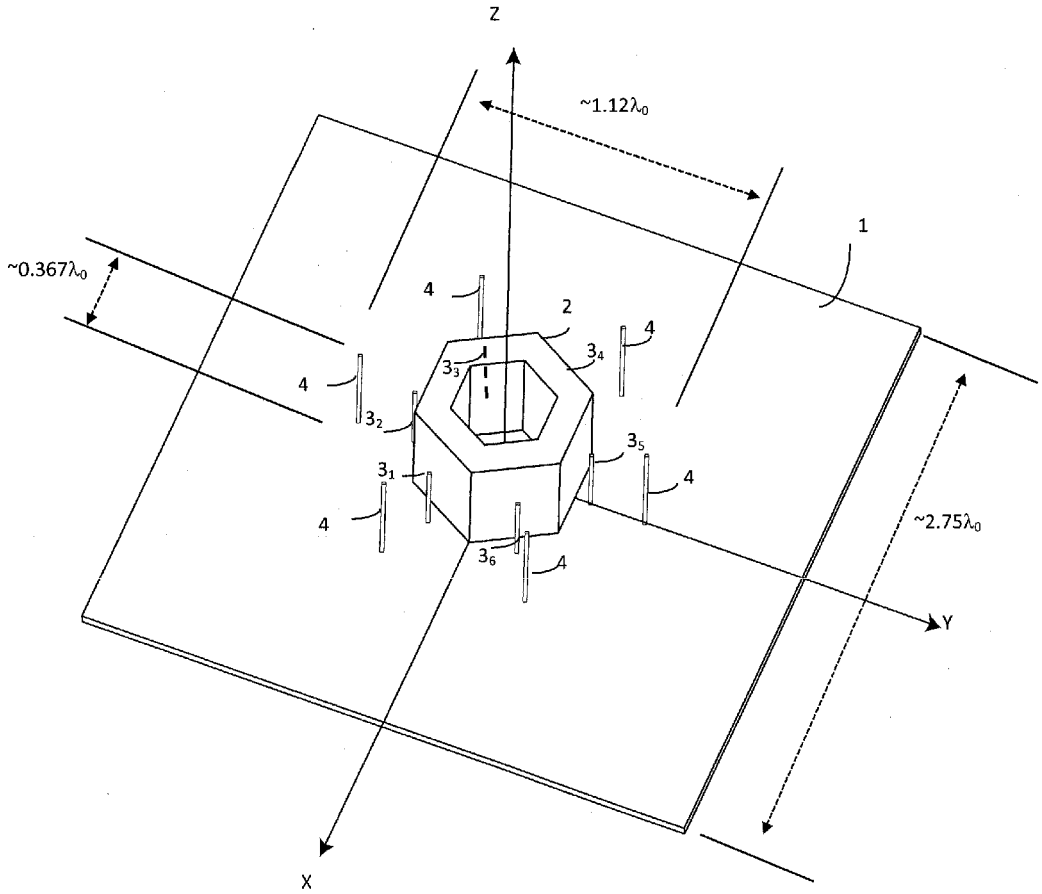
FIG. 1 is a diagrammatic perspective view of an embodiment of a multibeam antenna system in accordance with the present invention.

As shown in FIG. 1, in the centre of a substrate 1 forming a ground plane a lens 2 is mounted. This lens 2 is a part in plastic material, which has been machined or moulded. In the embodiment shows, the lens is made using polymethylmethacrylate of (PLEXIGLAS®) which has a permittivity $\in r=3.4$ and a tangent D=0.001. However, it is evident to those in the profession that the lens can be produced in other materials such as acrylonitrile-butadiene styrene known under the name ABS or in ceramic or magneto-dielectric materials.

More generally, any material having a permittivity and/or a permeability different from 1 can be used to produce the lens. In the embodiment of FIG. 1, the lens has the shape of a cylindrical ring with a parallelepipedic cross-section, more particularly hexagonal. However, the lens can have a circular ring shape.

As shown in FIG. 1, radiating elements constituted by monopoles $\mathbf{3}_1, \mathbf{3}_2, \mathbf{3}_3, \mathbf{3}_4, \mathbf{3}_5, \mathbf{3}_6$ are positioned on the substrate 1 around lens 2. Preferentially, these radiating elements are placed symmetrically on a circle to obtain a uniformity of radiation patterns between each other.

In FIG. 1, each radiating element $3_1$ to $3_6$ is positioned in the middle of one face of the hexagonal lens. Moreover, in the embodiment shown, the monopoles are quarterwave monopoles. Each monopole is associated with a reflective element 4 positioned in front of the lens, which enables the radiation of the source to be brought in the direction of the lens. It is evident to a person skilled in the art that the radiating elements can be constituted by elements other than monopoles, namely patches or possibly slots.

According to a characteristic of the present invention, the thickness of the ring forming lens 2 was optimised to be close to λg/4 where λg is the guided wavelength and is equal to $$\frac{\lambda 0}{\sqrt{\varepsilon r \mu r}},$$

with λ0 the wavelength in a vacuum, ∈r the permittivity and μr the permeability of the material forming the lens.

A description will now be made of the embodiment according to the configuration of FIG. 1, which was used to conduct simulations by using the 3D electromagnetic software HFSS of the ANSYS company, based on the finite element method. In this case the following dimensions were used.

The substrate is a substrate in a known material FR4 formed by a square of length ~2.75 λ0.

The distance between the centre of a reflective strand 4 and the centre of a radiating element is 0.15 λ0.

The distance between a radiating element 3 and the external wall of the lens 2 is 0.0725 λ0.

The internal diameter of the lens 2 is 0.4 λ0.

The height of a reflective strand 4 is 0.3λ0.

The height of a monopole is 0.25 λ0.

The height of the plastic lens is 0.367 λ0.

As shown in FIG. 1, the distance between two diametrically opposed reflectors in relation to an x access is ~1.12 λ0.

Figure 2:
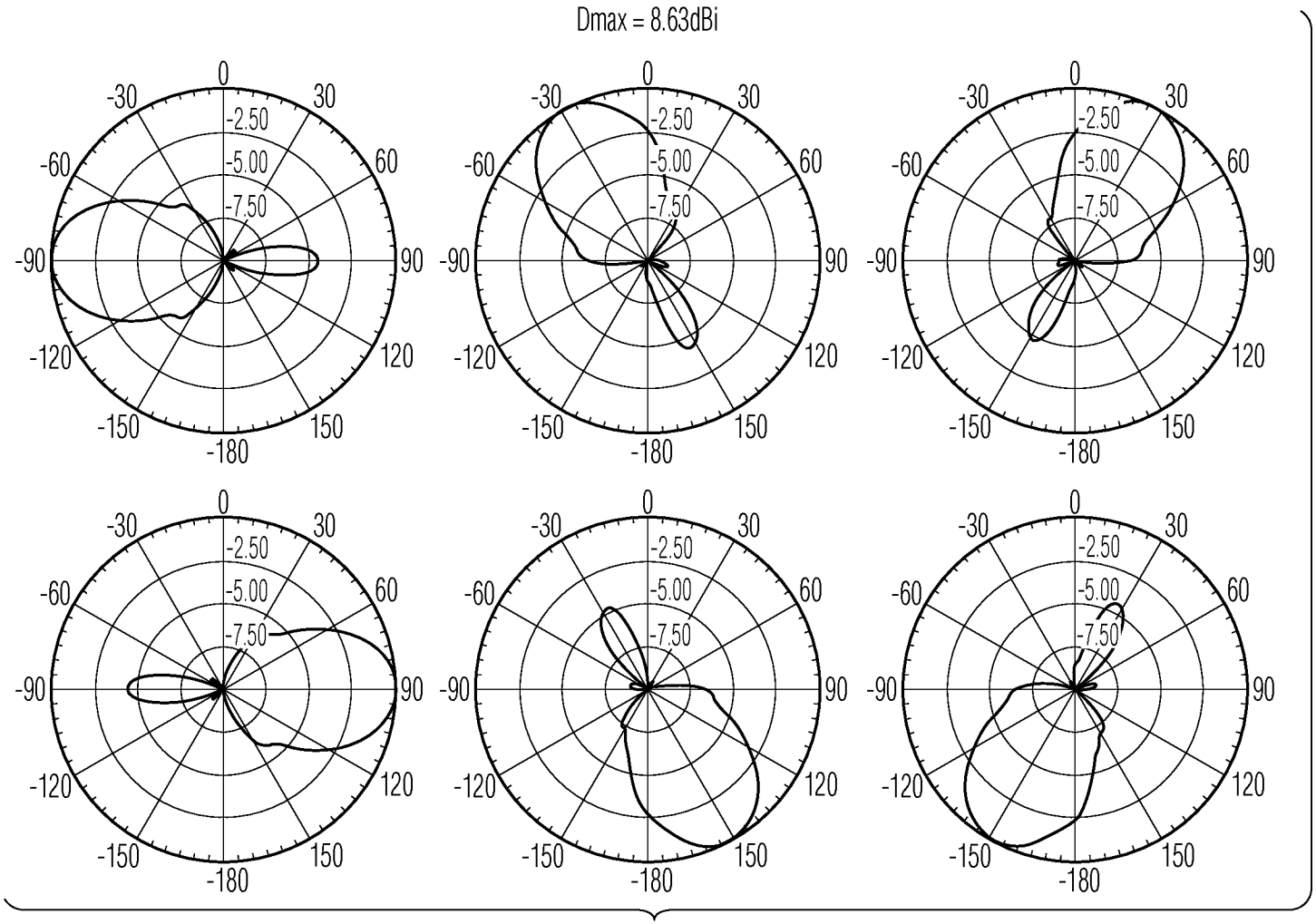
FIG. 2 shows the different radiation patterns as a function of the access.
Figure 4:
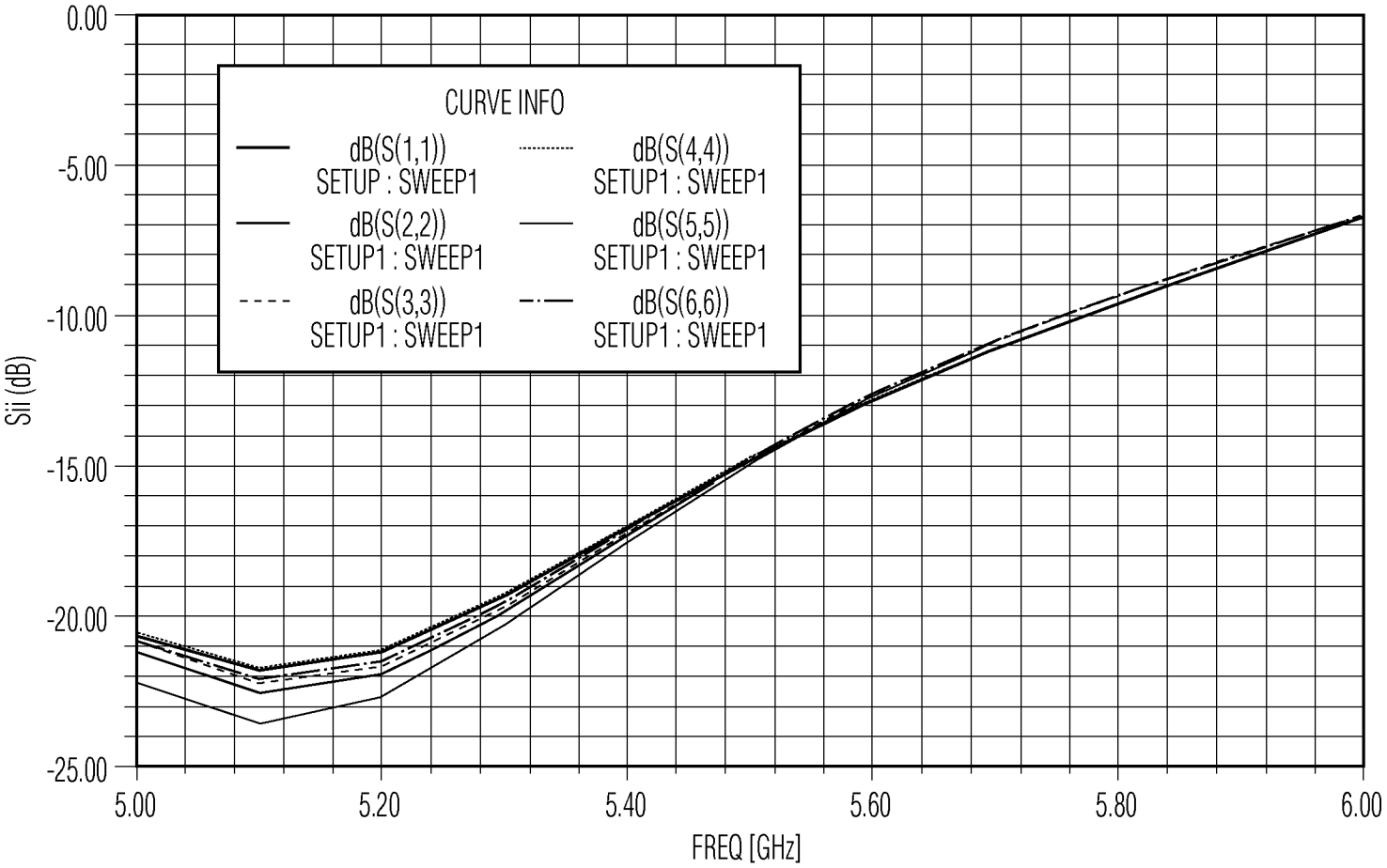
FIG. 4 shows a curve indicating the impedance matching as a function of frequency for the different radiating elements of the system in FIG. 1.

By using the aforementioned dimensions, different patterns and curves shown in FIGS. 2 to 4 were obtained.

FIG. 2 shows that by exciting the accesses of the six monopoles $3_1$ to $3_6$ separately, six standard radiation patterns of the total field are obtained pointing in six different directions of space. Hence, it is possible to cover the entire azimuthal plane while offering a spatial filtering with respect to interfering elements positioned in other angular sectors. To do this, the radiating elements $3_1$ to $3_6$ can be connected to a switching matrix not shown in FIG. 1, which serves as an interface between a MIMO type digital circuit and which enables three sectors among the six available to be chosen.

It is also evident that, in the antenna system of FIG. 1, all the radiating elements can be used simultaneously if necessary.

In FIG. 3, the standard radiation patterns of the total field were shown as a function of frequency for an access between 5 GHz and 6 GHz. The curves shown in FIG. 3 show that the radiation remains uniform overall, namely that the opening at +/−30° is respected for an oscillating level between −2.5 dB and −4 dB with respect to the maximum.

The curves of FIG. 4 show that the impedance matching levels are less than −10 dB up to a frequency of around 5.75 GHz. These levels can be readjusted to cover the entire WiFi band at 5 GHz by optimising, for example, the geometry of the lens or by adding an impedance matching network.

The embodiment described above is a simple and low cost embodiment using low cost materials such as a plastic material for the lens, an FR4 type substrate for the substrate and metal strands for the radiating elements and reflective elements. Moreover, the dimensions of the lens, namely the interior and exterior diameters of the ring, the distance between the source and the reflective element, the distance between the wall of the lens as well as the height and position of the lens and the number of sources, make it possible to optimise the directivity and the level of matching in the targeted frequency band.

What is claimed is:

1. A Multibeam antenna system comprising:
- a substrate forming a ground plane,
- a lens positioned on the substrate,
- a plurality of radiating elements configured to transmit and/or receive electromagnetic waves, said radiating elements being positioned on the substrate around the lens,
- a plurality of reflective elements arranged around the plurality of radiating elements;
- each radiating element being associated with a respective reflective element for directing, by reflection, radiation from the respective radiating element to the lens; and
- a switching device configured to select at least one of the radiating elements,
- wherein the lens comprises a cylindrical ring whose axis is perpendicular to the substrate.

2. The antenna system according to claim 1, wherein the cylindrical ring has an cross-section a circular or parallelepipedic shape.

3. The antenna system according to claim 2, wherein the cylindrical ring has a thickness close to λg/4 where λg is the guided wavelength and equal to $$\frac{\lambda 0}{\sqrt{\varepsilon r \mu r}}$$

(λ0 the wavelength in a vacuum, ∈r and μr respectively the permittivity and permeability of the material forming the lens).

4. The antenna system according to claim 1, wherein the material of the lens is chosen from among plastic materials comprising polymethylmethacrylate, acrylonitrile butadiene styrene (ABS), ceramics, and magneto dielectric materials.

5. The antenna system according to claim 1, wherein the radiating elements are chosen from among the monopoles, patches, slots.

6. The antenna system according to claim 1, wherein the radiating elements are positioned on a circle circumscribing the lens.

* * * * *